US005734398A

United States Patent [19]

Mitani

[11] Patent Number: 5,734,398

[45] Date of Patent: Mar. 31, 1998

[54] THERMAL INK JET PRINTER AND A METHOD OF DRIVING THE SAME

[75] Inventor: Masao Mitani, Hitachinaka, Japan

[73] Assignee: Hitachi-Koki Co., Ltd., Tokyo, Japan

[21] Appl. No.: 405,709

[22] Filed: Mar. 17, 1995

[30] Foreign Application Priority Data

Mar. 18, 1994 [JP] Japan ..... 6-049202

[51] Int. Cl.[6] ..... B41J 2/05

[52] U.S. Cl. ..... 347/57

[58] Field of Search ..... 347/12, 13, 57, 347/62, 63, 65, 182

[56] References Cited

U.S. PATENT DOCUMENTS

| | | | |
|---|---|---|---|
| 4,683,481 | 7/1987 | Johnson | 347/65 |
| 5,142,296 | 8/1992 | Lopez et al. | 347/12 |
| 5,537,133 | 7/1996 | Marler | 347/18 |

*Primary Examiner*—Benjamin R. Fuller
*Assistant Examiner*—Juanita Stephens
*Attorney, Agent, or Firm*—Whitham, Curtis, Whitham & McGinn

[57] ABSTRACT

A thermal ink jet printer includes a plurality of ink channels filled with ink, and a plurality of nozzles corresponding to respective ones of the plurality of ink channels individually. Each nozzle brings the corresponding ink channel into fluid communication with an outside atmosphere. A plurality of protection-layerless heaters are provided on respective ones of the plurality of ink channels individually to face a corresponding nozzle. An LSI device with drive circuits is connected to each heater for applying a print signal to a selective one of the heaters. To drive the printer, every other heater is sequentially driven at a predetermined interval of less than 1 microsecond so that ink droplets are sequentially ejected, when the print signals are produced, from odd-numbered nozzles and thereafter from even-numbered nozzles. To this effect, each of the heaters is applied with a pulse of voltage having a duration of 3 microseconds or less so that a portion of the ink in a corresponding ink channel is rapidly vaporized to produce a bubble caused by fluctuation nucleation. Expansion of the bubble ejects the ink droplet from a corresponding nozzle. At least 20 microseconds is paused between the ejection of the ink droplets from the odd-numbered nozzles and the ejection of the ink droplets from the even-numbered nozzles.

17 Claims, 5 Drawing Sheets

THERMAL INK JET PRINTER AND A METHOD OF DRIVING THE SAME

BACKGROUND OF THE INVENTION

1. Field of the Invention

The present invention relates to a thermal ink Jet printer wherein thermal energy is used for ejecting ink droplets from a print head so that the ink droplets impinge on a recording medium and form an image.

2. Description of the Related Art

Two types of ink jet heads have been produced for use in thermal ink jet printers. The first type is described in, for example, Japanese Patent Application Kokai Nos. SH0-54-161935, SHO-55-27281, and SH0-55-27282. In the first type, the heaters are formed on the floor (substrate-side) of ink channels so that the surface of each heater is aligned parallel with the direction in which ink is ejected. The second type is described in, for example, Japanese Patent Application Kokai No. SH0-54-51837. In the second type, the surface of each heater is aligned perpendicular to the direction of ejection. According to the August 1988 edition of The Hewlett Packard Journal and the Dec. 28, 1992 edition of Nikkei Mechanical (see page 58), both types of ink jet heads eject ink droplets by rapidly vaporizing ink with a pulse of heat to produce a bubble that rapidly expands and contracts. The expansion of the bubble forces an ink droplet from a nozzle in the print head. Heaters used in both types of print head are constructed from a thin-film resistor covered with several protective layers.

The present inventor proposed forming a protection-layerless heater from thin-film resistor and conductor materials. The absence of protection layers to the heater greatly improves efficiency of heat transmission from the heater to the ink. This allows great increases in print speed, i.e., in frequency at which ink droplets can be ejected. A print head wherein such heaters are used can be more simply produced.

The present inventor also proposed the most effective drive conditions for driving the protection-layerless heaters as disclosed in co-pending U.S. application Ser. No. 08/331,742 filed Oct. 31, 1994. The excellent generation and contraction characteristics of bubbles generated under these drive conditions improve the stability of ink ejection and ink ejection frequency.

As described in Japanese Patent Application Kokai Nos. SHO-59-138459 and SHO-59-207264, careful consideration must be given when designing ink channels in order to avoid cross-talk in high-density conventional thermal ink jet print heads.

SUMMARY OF THE INVENTION

An object of the present invention is to provide a method of driving a print head using the above-described protection-layerless heater wherein crosstalk can be substantially eliminated without special attention being paid to the design of the ink channels.

Another object of the present invention is to provide a thermal ink jet printer that can print at a high speed with an excellent print quality.

Detailed investigations of the generation and collapse of bubbles formed using the protection-layerless heater and of the effects the bubbles have on ink have led to an improved method for driving the print heads.

To achieve the above and other objects, there is provided a thermal ink jet printer which includes a common ink channel filled with ink, and a plurality of ink channels each in fluid communication with the common ink channel. Each of the plurality of ink channels has a bottom plate and partition walls whose height is less than 30 μm. A plurality of nozzles are provided corresponding to respective ones of the plurality of ink channels individually. Each of the plurality of nozzles brings the corresponding ink channel into fluid communication with an outside atmosphere. A plurality of heaters are provided individually on respective bottom plates of the plurality of ink channels so that a surface of the heater is substantially perpendicular to a direction in which the ink droplet is ejected and so that an inner perimeter of the nozzle when projected on the heater as aligned with the heater is within 5 μm of the edge of the heater facing the ink channel. A driving means is connected to each of the plurality of heaters, for applying a pulse of voltage to a selective one of the plurality of heaters in response to a print signal.

In driving the printer, the driving means sequentially drives every other heater at a predetermined interval of less than 1 microsecond so that ink droplets are sequentially ejectable from the odd-numbered nozzles and thereafter sequentially ejectable from the even-numbered nozzles, by applying to each of the heaters the pulse of voltage having a duration of 3 microseconds or less so that a portion of the ink in a corresponding ink channel is rapidly vaporized to produce a bubble caused by fluctuation nucleation. Expansion of the bubble ejects the ink droplet from a corresponding nozzle. At least 20 microseconds is paused between the ejection of the ink droplets from the odd-numbered nozzles and the ejection of the ink droplets from the even-numbered nozzles.

It is preferable that the time between the ejection of the ink droplets from the odd-numbered nozzles and the ejection of the ink droplets from the even-numbered nozzles be more than 30 microseconds.

Preferably, the ink nozzle has an outside surface separated from the surface of the heater by a distance more than 30 μm.

BRIEF DESCRIPTION OF THE DRAWINGS

The above and other objects, features and advantages of the invention will become more apparent from reading the following description of the preferred embodiment taken in connection with the accompanying drawings in which:

FIG. 4(*b*) is another cross-sectional view (B-B' cross-section) showing the thermal ink jet print head shown in FIG. 4(*a*);

FIG. 7(*b*) is another cross-sectional view (B-B' cross-section) showing the thermal ink jet print head shown in FIG. 7(*a*).

DETAILED DESCRIPTION OF THE PREFERRED EMBODIMENTS

Figure 1:
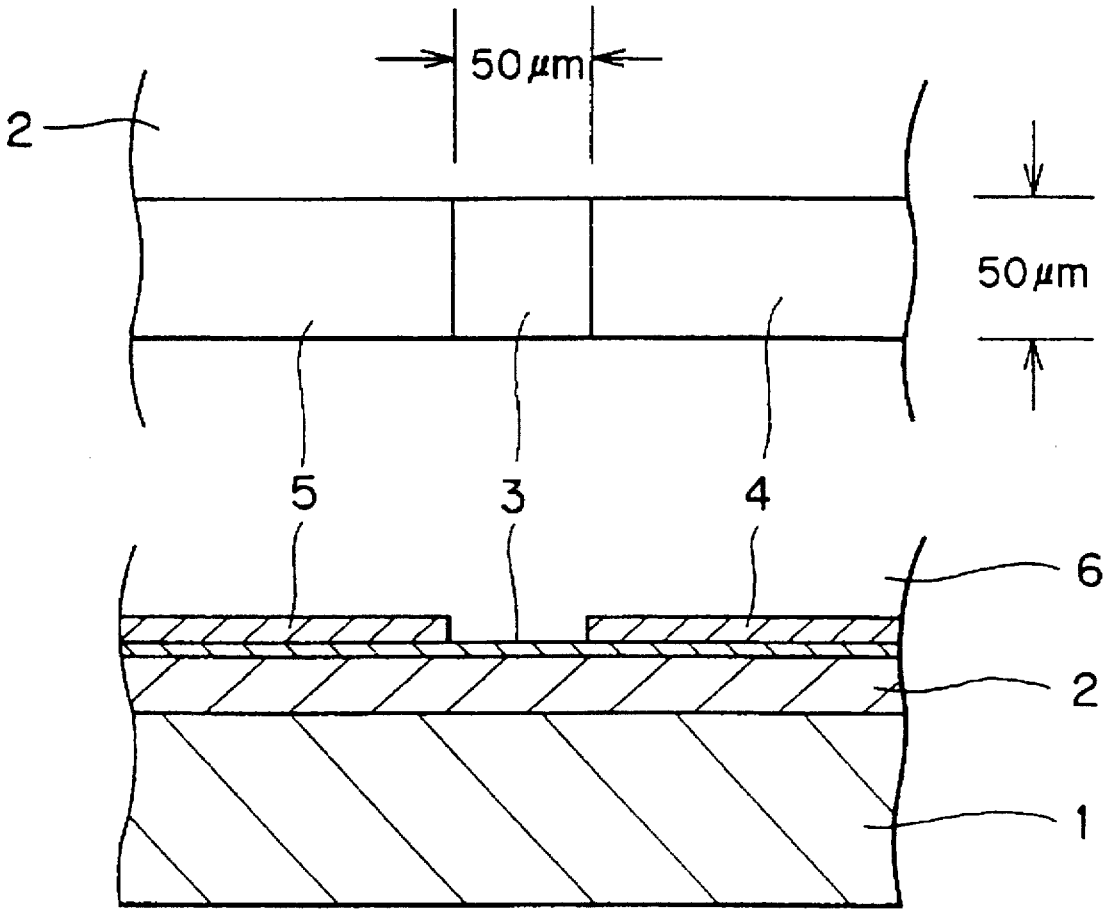
FIG. 1 includes a plan view and a cross-sectional view both showing a heater used in the invention.

A thermal ink jet print head according to preferred embodiments of the present invention will be described while referring to the accompanying drawings wherein like parts and components are designated by the same reference numerals to avoid duplicating description.

FIG. 1 shows planer and cross-sectional views of a highly reliable protection-layerless thin film heater as described in co-pending U.S. application Ser. No. 08/172,825 filed Dec. 27, 1993. In this protection-layerless thin film heater, a 2 μm thick thermally insulating $SiO_2$ layer 2 is formed on an approximately 400 μm thick silicon substrate, and a thin film resistor 3 of 0.1 μm thickness is formed on the $SiO_2$ layer 2. Conductors 4 and 5 each being 0.1 μm thickness are formed on the thin film resistor 3. In this example, the thin film resistor 3 is made from a Cr—Si—SiO alloy thin film resistor and the conductors 4 and 5 are made from nickel (Ni). However, the film resistor 3 could be made from a Ta—Si—SiO alloy in lieu of Cr—Si—SiO alloy, and the conductor material could be tungsten (W) or tantalum (Ta). The resistance of the resistor 3 is about 1 KΩ. Despite requiring no protective layers, this heater has a sufficient life when applied with pulses of voltage to heat in water or water-based ink.

Figure 2:
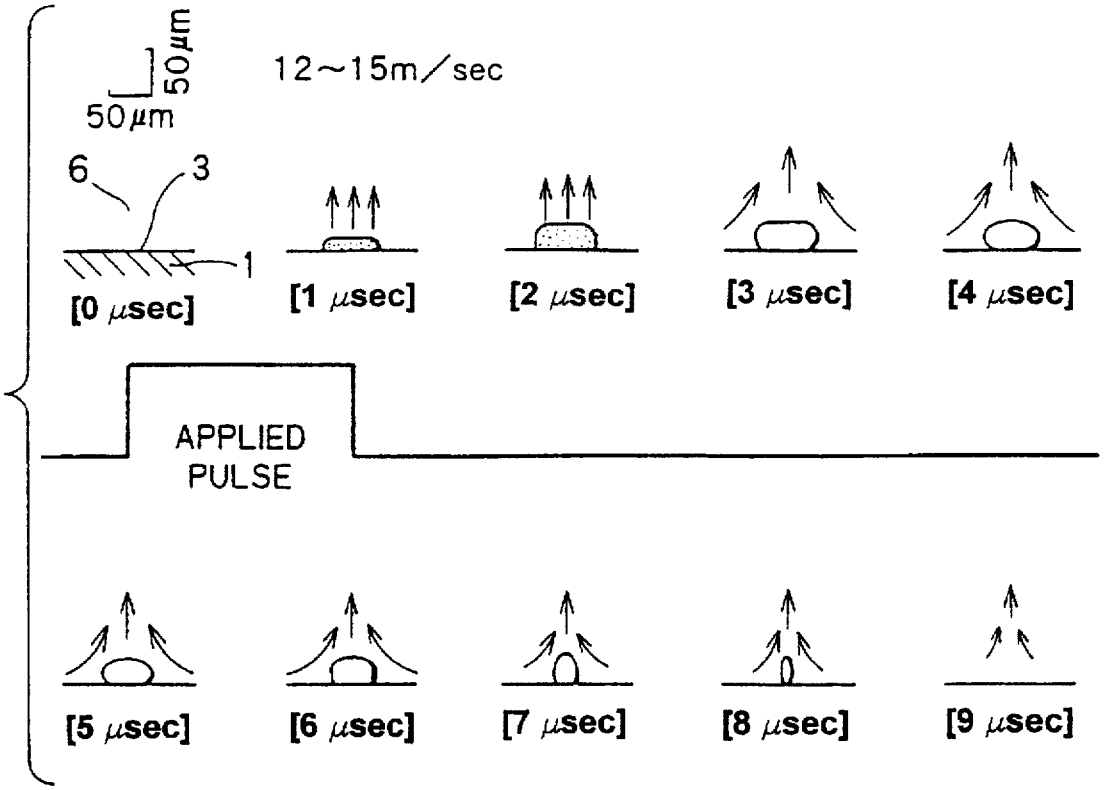
FIG. 2 schematically shows temporal changes from generation to disappearance of a bubble generated in water by pulse heating by the heater shown in FIG. 1.

FIG. 2 is a pictorial representation of the generation and collapse of a bubble of water formed by pulse heating the heater 3 as observed using stroboscopic photography. To produce the bubble represented in FIG. 2, power of 2.5 W/dot was applied in 1 μs pulses to the heater 3 at a frequency of 1 KHz. The strobe light was illuminated in approximately 1 μs long pulses. The water 6 to be ejected (before ejection) was about 25° C. Under these conditions, the bubble was generated by fluctuation nucleation boiling as described in co-pending U.S. application Ser. No. 08/331,742.

As can be seen in FIG. 2, the bubble grows to a height of 5 to 10 μms about 1 μs after the start of the thermal pulse. This means that boiling starts rapidly, in about ½ to 1 μs. Regardless of the shape of the heater 3, the bubble expands predominantly upward without growing laterally more than 5 to 10 μm beyond the edges of the heater 3. The height of the bubble is about 30 μm at the maximum stage of growth.

The arrows in FIG. 2 show the flow of water as concluded from observations of the expansion and contraction of bubbles. The expanding bubble pushes into the water in the vertical direction at a high speed of 12 to 15 m/s (i.e., 30 μms/2.0 to 2.5 μS). The average expansion rate (dv/dt)/v of the bubble is an extremely large value of 4 to $5\times10^5$/s (i.e., ½ to 2.5 μS). This is representative of bubbles generated by fluctuation nucleation boiling.

While the bubble is expanding, the vapor within the bubble is rapidly cooled by expansion of the bubble to create practically a vacuum state by transfer of heat the surrounding ink. When the bubble reaches its maximum size, it starts to collapse at the bottom. The inertia of the rapid flow of the water hinders contraction of the bubble in the vertical direction.

Figure 5:
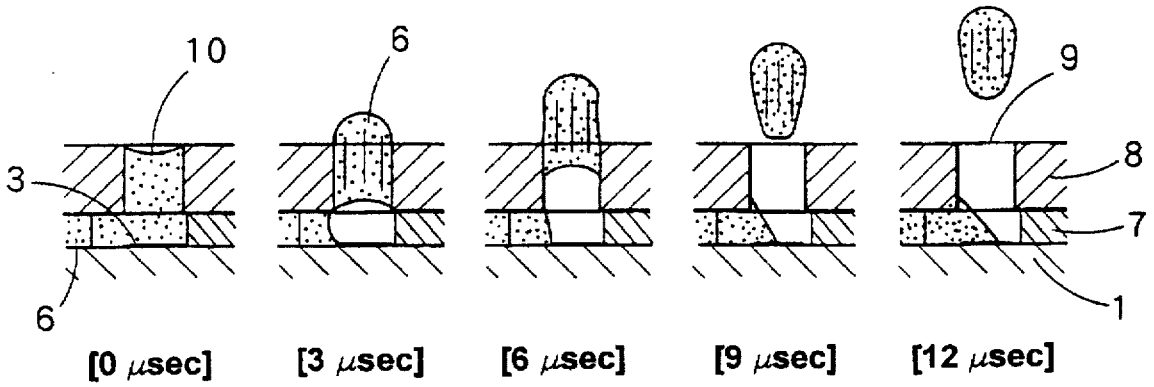
FIG. 5 is a cross-sectional view showing, from left to right, a chronology of events occurring in the head shown in FIGS. 6(*a*) and 6(*b*)

Rebound, that is, generation of secondary bubbles, which is caused by insufficient cooling of the heater, always appears when ejecting ink droplets with an ink jet print head produced using conventional technology. However, as can be seen in FIG. 2, no such undesirable phenomenon occurs when generating bubbles with protection-layerless heaters. As shown in FIG. 5, these characteristics barely change even if the excitation pulse width or the pulse power is increase by two or three times.

Figure 3:
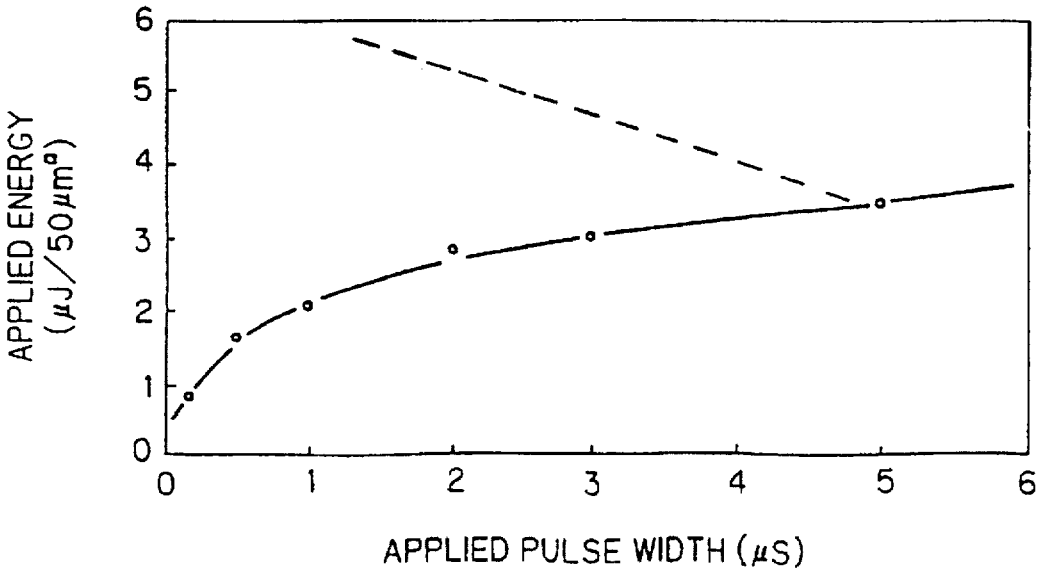
FIG. 3 is a graphical representation showing the relationship between energy level and pulse duration applied to the heater shown in FIG. 1 to induce fluctuation nucleation (solid line) and single bubble generation region (dash line)

FIG. 3 is a graphical representation showing a relationship between the energy level and the pulse duration applied to the heater shown in FIG. 1. In FIG. 3, fluctuation nucleation is shown as a solid line and the single bubble generation region is represented by the dashed line.

Figure 4:
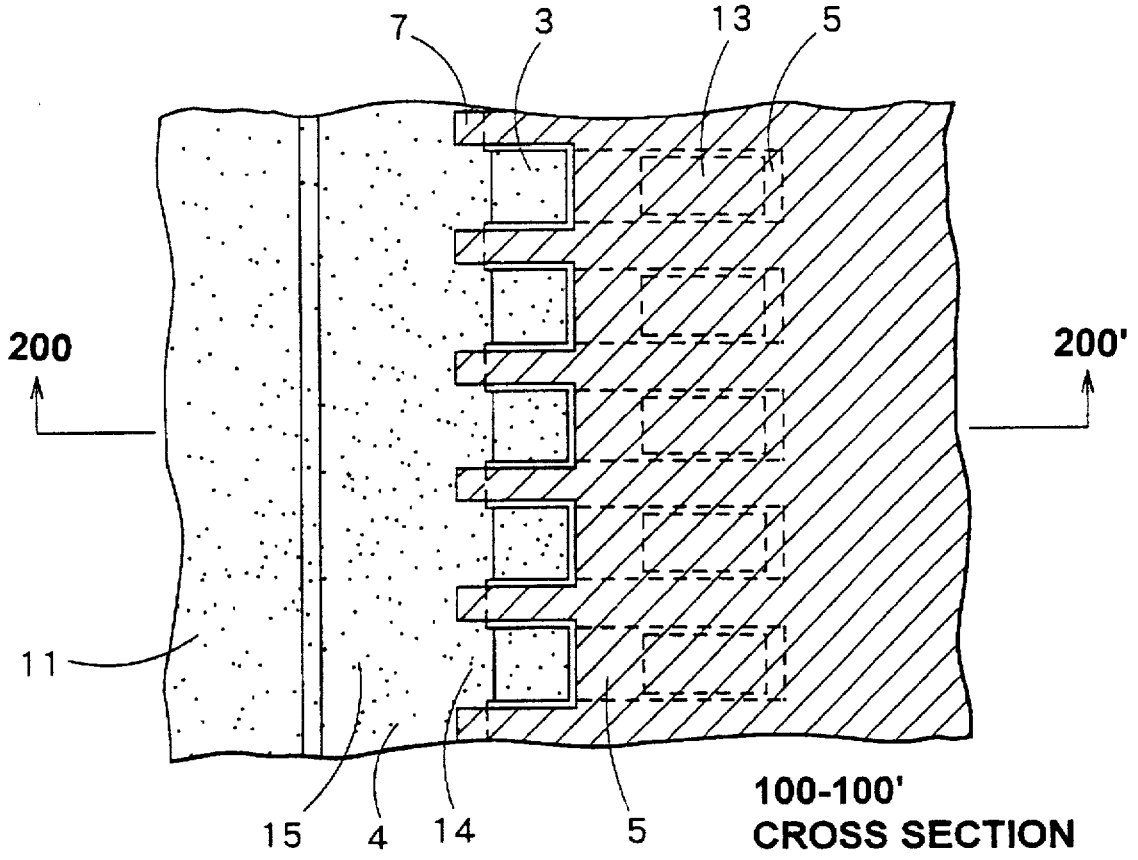
FIG. 4(*a*) is a cross-sectional view (A-A' cross-section) showing a thermal ink jet print head according to a first embodiment of the invention.
Figure 4:
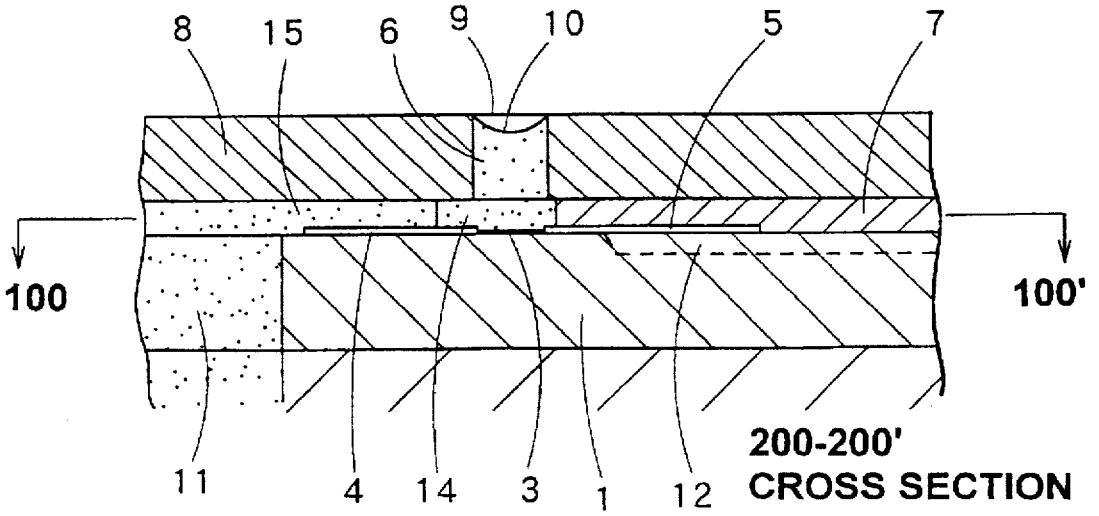

Top shooter type print heads, that is, print heads wherein the heaters are aligned perpendicular, or almost perpendicular, to the direction of ejection, are the most suitable for ejecting ink. FIGS. 4(*a*) and 4(*b*) show an example of a top shooter type print head with ink ejection nozzles 9 linearly aligned along the head spaced to produce 360 dots per inch (i.e., dpi). Heaters 3 with the structure as shown in FIG. 1 appear as 40 μm squares when viewed from the angle shown in FIG. 4(*a*). Partition walls 7 with a height of 25 μm form the inner-most wall near the nozzles of short individual ink channels 14 that have a width of 50 μm. A nickel thin-film common energization line 4 and individual lines 5 are provided in connection with the heaters 3. A drive LSI device 12 with drive circuits is formed on the silicon substrate 1. The individual lines 5 are connected to the drive circuits by a through hole 13. An orifice plate 8 formed with 40 μm diameter ink ejection nozzles is assembled to the partition walls 7 and the substrate 1 so that one ink ejection nozzle is aligned directly above each heater 3. Water-based ink 6 is supplied from the ink supply channel 11 to the ink ejection nozzles by passing through a common ink channel 15 and the individual ink channels 14. Ink was ejected from one of the nozzles by applying voltage (1.6 W/dot in 1 μS pulses repeated at a frequency of 1 KHz to the corresponding heater 3. Observations were made based on the meniscus position 10 and on the behavior of the ejected ink using stroboscopic photography at 1 μS pulse intervals.

FIG. 5 shows the behavior of ink and bubbles in each ink channel 14 (FIG. 4(*a*) as estimated from the experimental results shown in FIG. 2. About 3 μS is required for the bubble to attain its maximum size. Until then, the bubble rapidly lifts the ink above the heater upward. This contributes to an initial speed in the ink of 12 to 15 m/s. Because the bubble shows virtually no lateral growth, only a small amount of pressure (crosstalk) is applied to the adjacent ink channels. Therefore, the position of the menisci of adjacent nozzles is only raised slightly. The menisci of adjacent nozzles show particularly little movement up until about 1 μS after application of the pulse of voltage. It was confirmed that the menisci of nozzles four to five nozzles or more distance away from the fired nozzle showed virtually no movement even at about the 2 μS time point after application of the pulse, which is the time when adjacent nozzles are most influenced by crosstalk.

On the other hand, the bubble is substantially in a vacuum state at the time point 3 μS after application of the pulse. Therefore, the ink in each ink channel begins to flow toward the heater at this time point at a pressure difference of about one atmosphere. The ink flows fastest when the elected ink separates from the nozzle between 7 and 8 μS after application of the voltage pulse because this is when the one atmosphere pressure difference vanishes. Afterward the speed of flow rapidly drops. The meniscus will recover its original position about 60 to 70 μS later. The influence (crosstalk) to the adjacent nozzles is greatest between 7 and 8 μS after application of the pulse of voltage when the ink flows the fastest. The menisci of adjacent nozzles drop at this time by only 5 to 10 μm. Also, the time required for the meniscus of the fired nozzle to return to its standard position is 10 to 15 μS. The menisci of adjacent nozzles recover their standard position at about the 20 μS time point after application of the pulse.

However, the menisci take much longer to recover in a head with construction that results in the generation of subdroplets. For example, the meniscus of such a nozzle from which a droplet is ejected can take from 120 to 150 μS to recover and the meniscus of adjacent nozzles (not fired) can take as long as 60 to 80 μS to recover. This is because a long tail is drawn along with the ejected ink. This long tail prevents the flow speed of the ink from dropping, which results in an increase in the duration of crosstalk.

The effectiveness of the present invention can be understood by considering the above-described test results. Every other nozzle of a high-density array of linear or substantially linear ink ejection nozzles are sequentially driven, thereby completely eliminating reduction in print quality caused by coupling of ink droplets in flight. Alternate nozzles are sequentially driven also to reduce crosstalk, which decreases with increasing distance between nozzles. By further driving alternate nozzles separated by the time interval where no crosstalk between adjacent nozzles is recognized, i.e., 1 μS or less, ejection from the odd-numbered row of nozzles can be completed before the affects of crosstalk appear.

Next, ejection from the even-numbered row of nozzles is started. However, as can be understood from the above-described test results, the menisci of ink in even-numbered nozzles, which were fluctuating as a result of ink ejection from odd-numbered nozzles, will have recovered their standard position when the time interval is 20 μS or more. Therefore, even-numbered nozzles can be cleanly ejected. However, the above explanation concerned crosstalk in nozzles adjacent to a single driven heater. In an actual head, all heaters are serially heated in alternation, resulting in great amounts of crosstalk between adjacent nozzles and a slight increase in recovery time of the menisci. During actual printing, not much difference in print quality could be recognized. However, the time lag between driving nozzles of odd- and even-numbered rows should be set to 30 μS or more to give sufficient margin.

It is necessary to again drive the even-numbered row as least 60 to 70 μS after the first drive of the odd-numbered row. However, coincidentally, this indicates that it is possible to set the time interval between the drive of odd-numbered rows and even-numbered rows to 35 μS. This contributes to the simplicity of the signal process system. The head has a high ejection frequency of about 15 KHz (i.e., 1/60 to 70 μS). This is about double the highest frequency possible by conventional technology. Even ink channels 14 that are formed as shown in FIGS. 4(*a*) and 4(*b*) to minimize resistance to flow show no influence of crosstalk. Forming ink channels 14 as shown in FIGS. 4(*a*) and 4(*b*) results in a short refill time of the ink into the nozzle after ejection. As described above, constructing the head so that no tails are formed to ejected ink droplets can further contribute to reduction of crosstalk time. At the same time, generation of subdroplets is prevented and print quality is increased. Also, the resistance to flow can be reduced in the ink channels 14. Therefore, the channels can be made with a lower ceiling without adversely influencing the refill time. That is, even if foreign matter is mixed in with the ink supplied from the ink supply channel 11, the low ceiling of the common ink channel 15 can act as a filter. Because the common ink channel 15 and the ink channels 14 are formed to the same height, if the height is set to 30 μm or less, which is the height at which generation of subdroplets is prevented, and moreover if the diameter of the ejection nozzles is multiplied by $2^{(-1/2)}$ and the ink channel height is set less that this value, even angular foreign matter that can pass through the common ink channel will be able to pass through the ink ejection nozzles without clogging the nozzles.

A printer with a high density of, for example, 800 dpi, has ejection nozzles will formed with a diameter of about 18 μm, so that it becomes necessary to reduce the height of the ink channels to about 10 μm. However even in this case, the distance between the heater and the upper surface of the nozzle (the aperture) must be maintained at 30 μm, because this the maximum height attained by bubbles generated by fluctuation nucleation boiling. If this dimension is maintained, because the bubble is at a virtual vacuum when at maximum size, ink will not splash from the ejection nozzles and a high level of print quality can be maintained.

Forming a heater in the ink ejection chambers becomes technically easy when using protection-layerless heaters. Also, a filter function can be automatically provided. Additionally, subdroplets are not generated and forming the ink channels is simple. The conventional limit for a high density integrated nozzle is about 400 dpi. However, by using protection-layerless heaters, a high-density head of 600 to 800 dpi is possible so that print quality can be greatly improved.

First Embodiment

The following is an explanation of a first embodiment of the present invention. The head shown in FIGS. 4(*a*) and 4(*b*) is of a so-called serial scan type and is constructed from 128 ink ejection nozzles 9 juxtaposed along a straight line at a pitch of about 70 μm and has a print density of 360 dpi. Each nozzle 9 has a 40 μm diameter. When printing, such a serial type head is reciprocally moved back and forth in a widthwise direction of a print paper while intermittently feeding the print paper by a paper feed mechanism (not shown) in a direction perpendicular to the moving direction of the head. The ink ejection nozzles 9 are arranged in the print paper feeding direction so that 128 dot lines are printable with each of the forward and backward movements of the head.

Ink channels 14 are formed to a width of 50 μm, a height of 25 μm, and a length of 70 μm. A Cr—Si—SiO alloy thin film resistor (heater) 3 is formed at the end of each ink channel 14. Each heater 3 is formed into a square shape with width of 40 μm. Two 1 μm thick nickel (Ni) thin film conductors 4 and 5 are connected to each heater 3. The conductor 4 is a common conductor commonly connected to the heaters 3, and the conductors 5 are individual conductors connected to respective ones of the heaters 3 individually. The resistance of the heaters 3 is about 400 ohms. A drive LSI device 12 is formed on the silicon substrate 1 from a shift register circuit and a plurality of drive circuits are provided corresponding to the ink ejection nozzles 9. Each conductor 5 is connected to a drive circuit by passing through a through hole 13. This configuration allows the sequential drive of the heaters 3 by an external signal. The orifice plate 8 is formed to a thickness of 60 μm.

Evaluation tests were performed on this head by filling it with water based ink, fixing it so the ejection nozzles 9 faced downward in confrontation with a print sheet separated from the nozzles by 1.0 mm. Print tests were performed by ejecting ink from the nozzles to impinge on a print sheet transported on belt. The sheet is fixed to the transport belt by suction through holes formed in the belt. Several heads with different sized nozzles were evaluated. Each head was evaluated in a fixed condition so that only crosstalk would effect printing. The heaters were energized with 1 μS long pulses of 1.6 W/dot power.

Crosstalk occurring when the nozzles were sequentially fired in alternation was evaluated. In order to sequentially consecutively eject ink from only odd-numbered nozzles, printing was performed using an alternating ON and OFF input signal transmitted at data transmission speeds of 1, 2, and 4 MHz. The results of these tests are shown in Table 1.

TABLE 1

| | | | |
|---|---|---|---|
| Data transmission speed (MHZ) | 1 | 2 | 4 |
| Time difference between ejection of odd-numbered nozzles (μS) | 2.0 | 1.0 | 0.5 |
| Print results | Poor | Good | Good |

When the data is transmitted at a speed of 2 MHz or more, that is, when the time difference between ink ejections from odd-numbered nozzles is 1 μS or less, the amount of elected ink is stable and crosstalk is not present. However, when the time difference is 2 μS, the dot size increases somewhat and some crosstalk can be observed. This trend remained the same even when the duration of the drive pulse applied to the heater was increased to 3 μS. When the duration of the pulse is increased, the sharper the differences in boiling start times between different heaters. The differences in boiling start times between different heaters is probably caused by nonuniform production of the head. Therefore, the shorter the duration of the drive pulse, the less crosstalk.

Next, the data transmission speed was set at 20 MHz so that sequential ejection from odd-numbered nozzles was completed in 6.4 μS (i.e., 64×0.1 μS=6.4 μS). Then after a predetermined interval of time, the even-numbered nozzles were sequentially fired by application of an alternating ON and OFF signal at a data transmission speed of 20 MHz. The results of the resultant print was evaluated. The results of tests with different time interval between odd- and even-numbered nozzles were evaluated as shown in Table 2.

TABLE 2

| | | | |
|---|---|---|---|
| Time difference between odd- and even-numbered nozzles (μS) | 10 | 20 | 30 |
| Evaluation of print quality | Poor | Fair to Good | Good |

When the time difference between even- and odd-numbered nozzles is 20 μS, dots printed by even-numbered nozzles tend to be small, but still large enough to produce satisfactory print quality. The ejection conditions described above are the most severe in terms of crosstalk. A time difference of 20 μS is sufficient for actual printing.

Next, tests were performed wherein even-numbered nozzles were fired 20 μS after a first firing of odd-numbered nozzles, and then odd-numbered nozzles were again fired. The data transmission speed was 20 MHz. The time interval between the first firing of even-numbered nozzles and the second firing of odd-numbered nozzles was changed and the results evaluated. The results of the evaluations are shown in Table 3.

TABLE 3

| | | | |
|---|---|---|---|
| Time difference between firing all nozzles and firing only odd-numbered nozzles (μS) | 50 | 70 | 90 |
| Evaluation of print quality | Poor | Good | Good |

Setting the time difference between the first of even-numbered nozzles and second firing of odd-numbered nozzles to a short 50 μS produced a clearly small dot size because of insufficient refill time. However, good printing could be obtained at 70 μS resulting in a repetition frequency of about 15 KHz. This conventionally impossible frequency is the result of a combination of improvements in addition to the above-described drive conditions for preventing crosstalk. That is, the ink channels 14 cause very little resistance to flow of ink, resulting in a very short refill time. Ink is ejected in a direction perpendicular to a protection-layerless heater by fluctuation nucleation boiling. Further, the head is constructed so as that tails are not formed to ejected ink droplets.

The same tests were performed under conditions to induce fluctuation nucleation boiling and with pulses of voltage to the heaters having duration of 3 μS. This tended to increase crosstalk somewhat. However, the resultant print had quality sufficient for practical purposes.

Second Embodiment

A head described in the first embodiment is usually serially scanned when printing is performed by scanning the head across the width of the recording sheet. Printing is performed by the head according to the first embodiment by first sequentially driving the odd-numbered nozzles at a time interval of, for example, 0.1 μS. Then, the even-numbered nozzles are sequentially driven 20 μS later at the same time interval of 0.1 μS. Next the odd-numbered nozzles are again driven 50 μS later. Accordingly, dots printed by the even-numbered nozzles are shifted a distance of 2/7 of dots printed by the odd-numbered nozzles on a side in which the head moves, thereby forming a staggered pattern. This problem can be remedied by staggering positions of nozzles in the manner shown in FIG. 6. The head in FIG. 6 is 360 dpi with the dots separated by a distance of about 70 μS, resulting in a correction amount of 20 μm.

Figure 6:
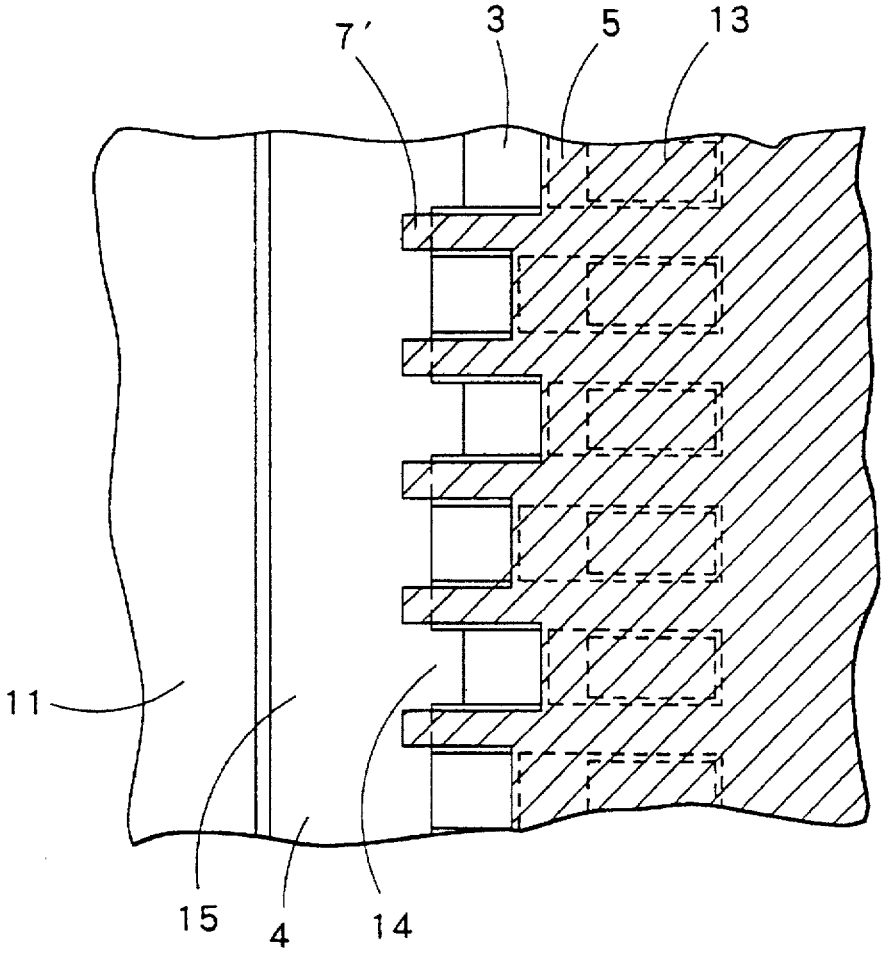
FIG. 6 is a cross-sectional view showing a print head according to a second embodiment of the present invention.

FIG. 6 shows a head wherein ink channels 14 and 15 are formed by partition walls 7'. It is desirable to make the partition walls 7' from a heat-resistant resin such as polyimide which has a thermal breakdown starting point of 400° C. or more. As can be seen in FIG. 6, the partition walls 7' cover part of the heaters 3' and all of the individual conductor wires 5 that are individually connected to the heaters 3. The ink acts like an electrolyte having the same potential as the common conductor wire. However, even if the individual conductor wires 5 have a higher (or lower) potential than the ink, there is no possibility of the individual conductor wires 5 being effected by galvanization.

The common conductor wire does not need to be covered with the same resin of the partition walls 7' because the common conductor wire and the ink are at the same potential so that the nickel thin-film metal forming the common conductor wire will not corrode.

The above-described structure allows construction of a head that is highly reliable in regards to electrolytic ink.

When printing is performed by reciprocally scanning the head shown in FIG. 6 across a print sheet at a speed twice that of when printing in a single direction, the transmission order of the print single can be reversed so that when traveling in one direction odd-numbered nozzles are fired and when traveling in the opposite direction even-numbered nozzles are fired. High-quality printing is possible at almost twice the print speed. Tests showed that this configuration and drive method allows printing of about 5 pages of A4 size print paper per minute.

Third Embodiment

Figure 7:
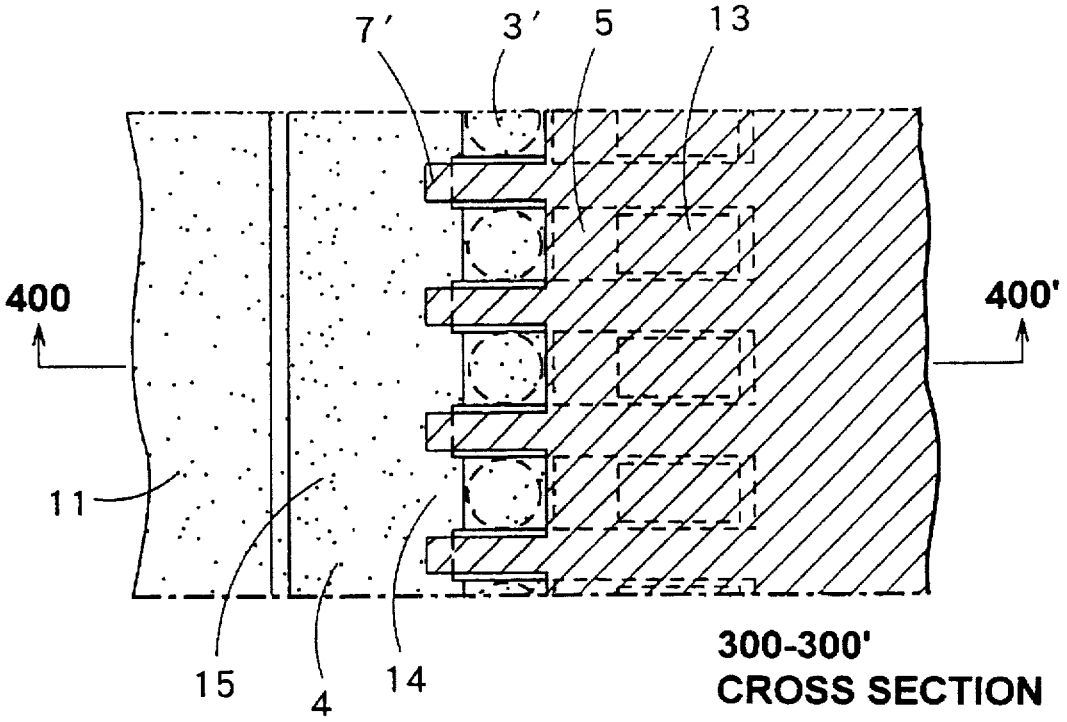
FIG. 7(*a*) is a cross-sectional view (A-A' cross-section) showing a thermal ink jet print head according to a third embodiment of the invention.
Figure 7:
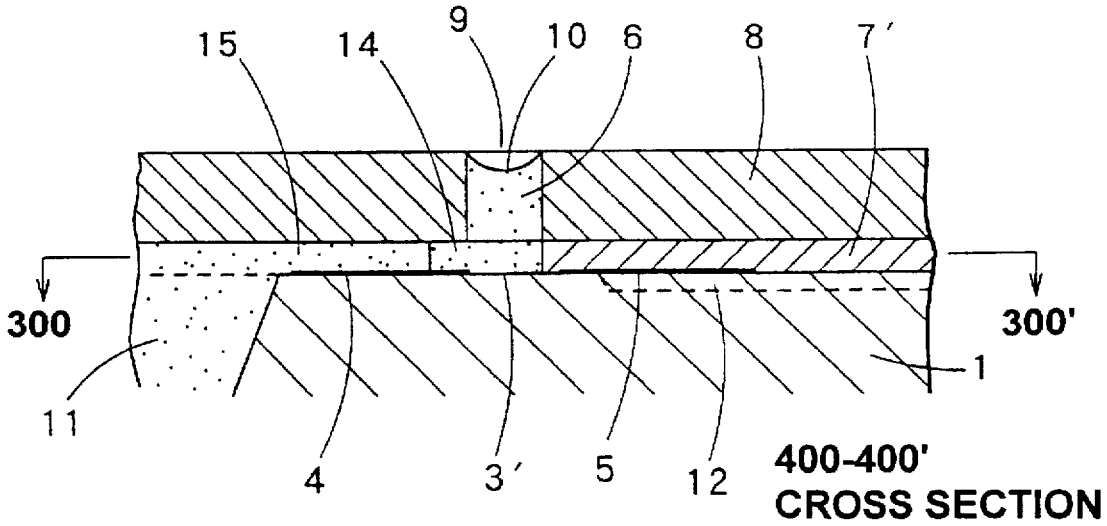

The following is an explanation of a third embodiment of the present invention. The head shown in FIGS. 7(*a*) and 7(*b*) is also of the serial type and is constructed from 128 ink ejection nozzles 9 juxtaposed along a line at a pitch of about 70 μm to having a print density of 360 dpi. Each nozzle 9 has a 40 μm diameter. Ink channels 14 are formed to a width of 50 μm, a height of 25 μm, and a length of 70 μm. A Ta—Si—SiO alloy thin film resistor (heater) 3' is formed at the end of each ink channel 14. Each heater 3 is formed into a square shape with width of 40 μm. Two 1 μm thick nickel (Ni) thin film conductors 4 and 5 are connected to each heater 3'. The partition walls 7', which form the ink channels 14 and 15, cover part of the heaters 3' and all of the individual conductor wires 5 that are connected to each Ta—Si—SiO alloy thin-film heater 3'.

The resistance of the heaters 3' is about 400 ohms. A drive LSI device 12 is formed on the silicon substrate 1 from a shift register circuit and a plurality of drive circuits. Each conductor 5 is connected to a drive circuit by passing through a through hole 13. This configuration allows sequential drive of the heaters 3' by an external signal.

Each Ta—Si—SiO alloy thin-film heater 3' is applied with a 1 ms duration pulse of voltage. This causes the surface of the Ta—Si—SiO alloy thin-film heaters 3' to oxidize to a thickness of about 1,000 Å. This oxidized surface prevents the nonoxidized inner portion of the Ta—Si—SiO alloy thin-film heaters 3' from coming directly into contact with the electrolytic ink. Therefore, the life of each Ta—Si—SiO alloy thin-film heater 3' will not be shortened by galvanization. Because the oxidized portion is extremely thin, heat is transferred to the ink equally as well as with the heaters of the first embodiment.

The orifice plate 8 is formed to a thickness of 60 μm. Evaluation tests were performed on this head by filling it with water based ink, fixing it so the ejection nozzles 9 faced downward in confrontation with a recording sheet separated from the nozzles by 1.0 mm. Print tests were performed by ejecting ink from the nozzles to impinge on a print sheet transported on belt. The sheet is fixed to the transport belt by suction through holes formed in the belt. Several heads with different sized nozzles were evaluated. Each head was evaluated in a fixed condition so that only crosstalk would effect printing. The heaters were energized with 1 μS long pulses of 2.0 W/dot power.

Printing was performed using this head under the same drive conditions as described in the above embodiment. The results were the same as those obtained in the tests of the first embodiment.

According to the present invention, crosstalk can be reduced regardless of the shape at which ink channels are formed. The repetition frequency of ink ejection can be increased by about double. Ejection of ink can be performed without generation of subdroplets. The present invention simultaneously solves the two main problems of conventional ink jet printers: slow print speed and print quality inferior to laser printers.

When ejecting ink from a high-density array of linearly or almost linearly aligned ink jet nozzles according to the ink jet recording method of the present invention, ink droplets will not couple in flight by serially electing ink droplets from alternate nozzles. Printing quality will not suffer. By reducing the time interval between alternate serial ejections to less than 1 μS, ink ejection operations begin before the effects of crosstalk are felt so that crosstalk does not influence ejected ink droplets. By setting the time interval to 20 μS or more, election from odd-numbered nozzles no longer effects the menisci of even-numbered nozzles and further ink ejection from even-numbered nozzles is normal. These characteristics result from fluctuation nucleation boiling induced by protection-layerless heaters. A heater with structure that prevents generation of subdroplets can also be constructed with protection-layerless heaters.

While several exemplary embodiments of this invention has been described in detail, those skilled in the art will recognize that there are many possible modifications and variations which may be made in these exemplary embodiments while yet retaining many of the novel features and advantages of the invention. Accordingly, all such modifications and variations are intended to be included within the scope of the appended claims. For example, this invention is applicable not only to the serial scan type head but also to a line scan type head wherein an increased number of nozzles are arranged along the entire width of the print paper to print one dot line substantially at a time.

What is claimed is:

1. A method of driving a thermal ink jet printer, the thermal ink jet printer including:

a common ink channel filled with ink;

a plurality of ink channels connected to the common ink channel;

a plurality of nozzles connected to respective ones of the plurality of ink channels, the plurality of nozzles being aligned along a straight line and being divided into odd-numbered nozzles and even-numbered nozzles, each of the plurality of nozzles bringing a corresponding ink channel into fluid communication with an outside atmosphere;

a plurality of heaters connected to respective ones of the plurality of ink channels each heater of said heaters being positioned to face a corresponding nozzle of said nozzles; and driving means, connected to each of the plurality of heaters, for selectively applying a print signal to each of the plurality of heaters, the method comprising steps of:

sequentially driving every other heater at a predetermined interval of no more than 1 microsecond so that ink droplets are first sequentially ejected from the odd-numbered nozzles and thereafter sequentially ejected from the even-numbered nozzles, said step of driving including applying a pulse of voltage having a duration of 3 microseconds or less to produce a bubble by fluctuation nucleation, wherein expansion of the bubble ejects an ink droplet from a corresponding nozzle; and pausing at least 20 microseconds from the ejection of the ink droplets from the odd-numbered nozzles before beginning ejection of the ink droplets from the even-numbered nozzles.

2. A method as claimed in claim 1, wherein said pausing step is more than 30 microseconds long.

3. A thermal ink jet printer comprising:

a common ink channel filled with ink;

a plurality of ink channels connected to the common ink channel, each of the plurality of ink channels having a bottom plate and partition walls;

a plurality of nozzles connected to respective ones of the plurality of ink channels, each of the plurality of nozzles bringing a corresponding ink channel into fluid communication with an outside atmosphere;

a plurality of heaters each connected to a respective bottom plate of the plurality of ink channels, said heaters being positioned so that a surface of each of said heaters is substantially perpendicular to a direction in which the ink droplet is ejected from a corresponding nozzle of said nozzles and so that an inner perimeter of said corresponding nozzle is aligned with an outer perimeter of said corresponding heater in said direction in which the ink droplet is ejected; and driving means connected to each of the plurality of heaters, for selectively applying a pulse of voltage to said corresponding heater in response to a print signal, wherein said driving means sequentially drives every other heater at a predetermined interval of no more than 1 microsecond so that ink droplets are first sequentially ejected from odd-numbered nozzles and thereafter sequentially ejected from even-numbered nozzles, said pulse of voltage having a duration of 3 microseconds or less so that a bubble is produced by fluctuation nucleation, wherein expansion of the bubble ejects the ink droplet from said corresponding nozzle, and wherein said driving means pauses at least 20 microseconds between the ejection of the ink droplets from the odd-numbered nozzles and the ejection of the ink droplets from the even-numbered nozzles.

4. A thermal ink jet printer as claimed in claim 3, wherein each of said plurality of heaters is provided with an oxidized surface.

5. A thermal ink jet printer as claimed in claim 4, wherein each said nozzle has an outside surface separated from a surface of each said corresponding heater by more than 30 μm.

6. A thermal ink jet printer as claimed in claim 5, further comprising a plurality of individual electrical conductors connecting said driving means to respective ones of said plurality of heaters, and wherein said plurality of individual electrical conductors and a part of each of said plurality of heaters are covered with said partition walls.

7. A thermal ink jet printer as claimed in claim 6, wherein said partition walls comprise a heat-resistant resin.

8. A thermal ink jet printer as claimed in claim 7, wherein said heat-resistant resin comprises polyimide and has a thermal breakdown starting point of 400° C. or more.

9. A thermal ink jet printer as claimed in claim 4, wherein each of said plurality of nozzles has a cylindrical configuration and an inner diameter, wherein a height of said partition walls is less than an inner diameter of the nozzle divided by a square root of 2.

10. A thermal ink jet printer as claimed in claim 9, wherein the ink nozzle has an outside surface separated from a surface of the heater by a distance more than 30 μm.

11. A thermal ink jet printer as claimed in claim 3, wherein the bottom plate comprises a silicon substrate, and wherein the heater comprises a $SiO_2$ thermal oxidation film having a thickness of 2 μm or less formed on said silicon substrate.

12. A thermal ink jet printer as claimed in claim 11, wherein the heater comprises a Cr—Si—SiO alloy.

13. A thermal ink jet printer as claimed in claim 11, wherein the heater comprises a Ta—Si—SiO alloy.

14. A thermal ink jet printer as claimed in claim 11, wherein said ink comprises a water-based ink.

15. The thermal ink jet printer as in claim 3, wherein said common ink channel has a height and said plurality of ink channels have said height.

16. The thermal ink jet primer as in claim 3, wherein said heaters comprise protection-layerless heaters.

17. The thermal ink jet printer as in claim 3, wherein said nozzles have a nozzle opening and said plurality of ink channels have a channel opening, wherein said nozzle opening is larger than said channel opening for filtering ink for said nozzle.

* * * * *